US008296987B1

(12) United States Patent
Dlubak et al.

(10) Patent No.: US 8,296,987 B1
(45) Date of Patent: Oct. 30, 2012

(54) SHOTGUN IMPROVEMENTS

(75) Inventors: David A. Dlubak, Upper Sandusky, OH (US); Aaron P. Welch, Wayne, OH (US)

(73) Assignee: Ithaca Gun Company, Upper Sandusky, OH (US)

( * ) Notice: Subject to any disclaimer, the term of this patent is extended or adjusted under 35 U.S.C. 154(b) by 172 days.

(21) Appl. No.: 12/686,554

(22) Filed: Jan. 13, 2010

Related U.S. Application Data

(60) Provisional application No. 61/144,267, filed on Jan. 13, 2009.

(51) Int. Cl.
*F41A 21/00* (2006.01)

(52) U.S. Cl. ..... 42/75.01; 42/75.02; 42/76.01

(58) Field of Classification Search ..... 42/76.01, 42/75.02, 77, 79, 75.04; 89/126, 1.41
See application file for complete search history.

(56) References Cited

U.S. PATENT DOCUMENTS

| | | | | | |
|---|---|---|---|---|---|
| 83,194 | A | * | 10/1868 | Maynard | 42/76.01 |
| 196,749 | A | * | 11/1877 | Wheeler | 42/76.01 |
| 2,137,259 | A | * | 11/1938 | Boak | 42/76.02 |
| 3,123,928 | A | * | 3/1964 | Lizza | 42/72 |
| 3,955,299 | A | * | 5/1976 | Bullis | 42/106 |
| 4,257,129 | A | * | 3/1981 | Volz | 623/20.33 |

* cited by examiner

*Primary Examiner* — Daniel Troy
(74) *Attorney, Agent, or Firm* — MacMillan, Sobanski & Todd, LLC

(57) ABSTRACT

A shotgun includes a first barrel having a first barrel muzzle end and a second barrel having a second barrel muzzle end. The shotgun includes an expansion joint provided adjacent the first barrel muzzle end and the second barrel muzzle end to connect together the first barrel muzzle end to the second barrel muzzle end. The expansion joint is operative to allow movement of one of the first and second barrels relative to the other one of the first and second barrels to prevent bowing thereof.

14 Claims, 10 Drawing Sheets

SHOTGUN IMPROVEMENTS

CROSS-REFERENCE TO RELATED APPLICATIONS

This application claims the benefit of U.S. Provisional Application Ser. No. 61/144,267, filed Jan. 13, 2009.

BACKGROUND OF THE INVENTION

This invention relates in general to firearms and in particular to improvements for use with shotguns.

Various types of firearms include handguns, such as for example pistols and automatics, and long guns, such as for example rifles and shotguns. Firearms generally comprise barrels within which high pressure combustion gas is created to force a projectile out one end of the barrel toward an intended target. A shotgun is a firearm that uses the energy of a fixed shell to fire a number of small spherical pellets called shot or a solid projectile called a slug. Shotguns are available in different calibers.

The caliber of a shotgun is measured in terms of gauge (U.S.) or bore (U.K.). The gauge number is determined by the number of solid spheres of a diameter equal to the inside diameter of the barrel that could be made from a pound of lead. For example, a 10 gauge shotgun nominally should have an inside diameter equal to that of a sphere made from one-tenth of a pound of lead. The most common gauges are 12 (having a 0.729 inch or 18.5 mm diameter) and 20 (having a 0.614 inch or 15.6 mm diameter) although other gauges are available.

Shotguns are also available in a range of firearm operating mechanisms, including breech loading, double, pump-, bolt-, and lever-action, semi-automatic, and even fully-automatic variants. Shotguns are available with single barrels or multiple barrels (commonly called double barrel shotguns). The most popular double barrel configurations are side-by side and over/under. Side-by-side barrel configurations have two barrels in a common horizontal plane. Over/under barrel configurations have two barrels in a common vertical plane.

Over/under shotgun barrel configurations allow a shooter to load and shoot multiple barrels. Over/under shotguns are almost universally break open actions, with the barrels tilting up at the rear to expose the breech ends of the barrels for unloading and reloading.

It would be desirable to provide an improved shotgun, in particular an improved over/under shotgun.

SUMMARY OF THE INVENTION

This invention relates to improvements for shotguns. According to one embodiment, a shotgun includes a first barrel having a first barrel muzzle end and a second barrel having a second barrel muzzle end. The shotgun includes an expansion joint provided adjacent the first barrel muzzle end and the second barrel muzzle end to connect together the first barrel muzzle end to the second barrel muzzle end. The expansion joint is operative to allow movement of one of the first and second barrels relative to the other one of the first and second barrels to prevent bowing thereof.

According to another embodiment, an over/under shotgun includes a first barrel having a first barrel muzzle end and a second barrel having a second barrel muzzle end. In this embodiment, an expansion joint is provided directly adjacent the first barrel muzzle end and the second barrel muzzle end to connect together the first barrel muzzle end to the second barrel muzzle end. The expansion joint is operative to allow movement of one of the first and second barrels relative to the other one of the first and second barrels.

According to another embodiment, a shotgun includes a first barrel having a first barrel breech end and a second barrel having a second barrel breech end. In this embodiment, the first barrel breech end and the second barrel breech end are configured for connection to a mono-block of the shotgun by tube nuts.

According to another embodiment, a shotgun includes a receiver having a tang mounting portion and a tang having a tang front portion mounted to the tang mounting portion. In this embodiment, the tang mounting portion of the receiver and the tang front portion are configured with mating cross-sectional shapes that allow the tang to be removably mounted to the receiver.

According to yet another embodiment, a shotgun includes a receiver having a plurality of channels, a plurality of cocking rods positioned within the plurality of channels, and a retaining member positioned to intersect the plurality of cocking rods. In this embodiment, the retaining member is configured to retain the cocking rods within the plurality of channels within the receiver as the cocking rods slide.

According to still yet a further embodiment, a shotgun includes a receiver having a plurality of indentations and a mono-block being hingeably connected to the receiver with the mono-block having a lower surface with a plurality of protrusions. In this embodiment, the plurality of protrusions on the lower surface of the mono-block securely engage the plurality of indentations on the receiver as the mono-block is pivoted into position against the receiver.

According to another embodiment, a shotgun includes a plurality of barrels connected to a mono-block and a receiver hingeably connected to the mono-block with the receiver including a lever actuated bolting mechanism. In this embodiment, the lever actuated bolting mechanism is configured to retract a plurality of locking bolts for breaking open the mono-block from the receiver and further configured to permit the locking bolts to seat against the mono-block when the mono-block is in a closed position against the receiver.

Other advantages of this invention will become apparent to those skilled in the art from the following detailed description of the preferred embodiments, when read in light of the accompanying drawings

DETAILED DESCRIPTION OF THE INVENTION

Figure 1:
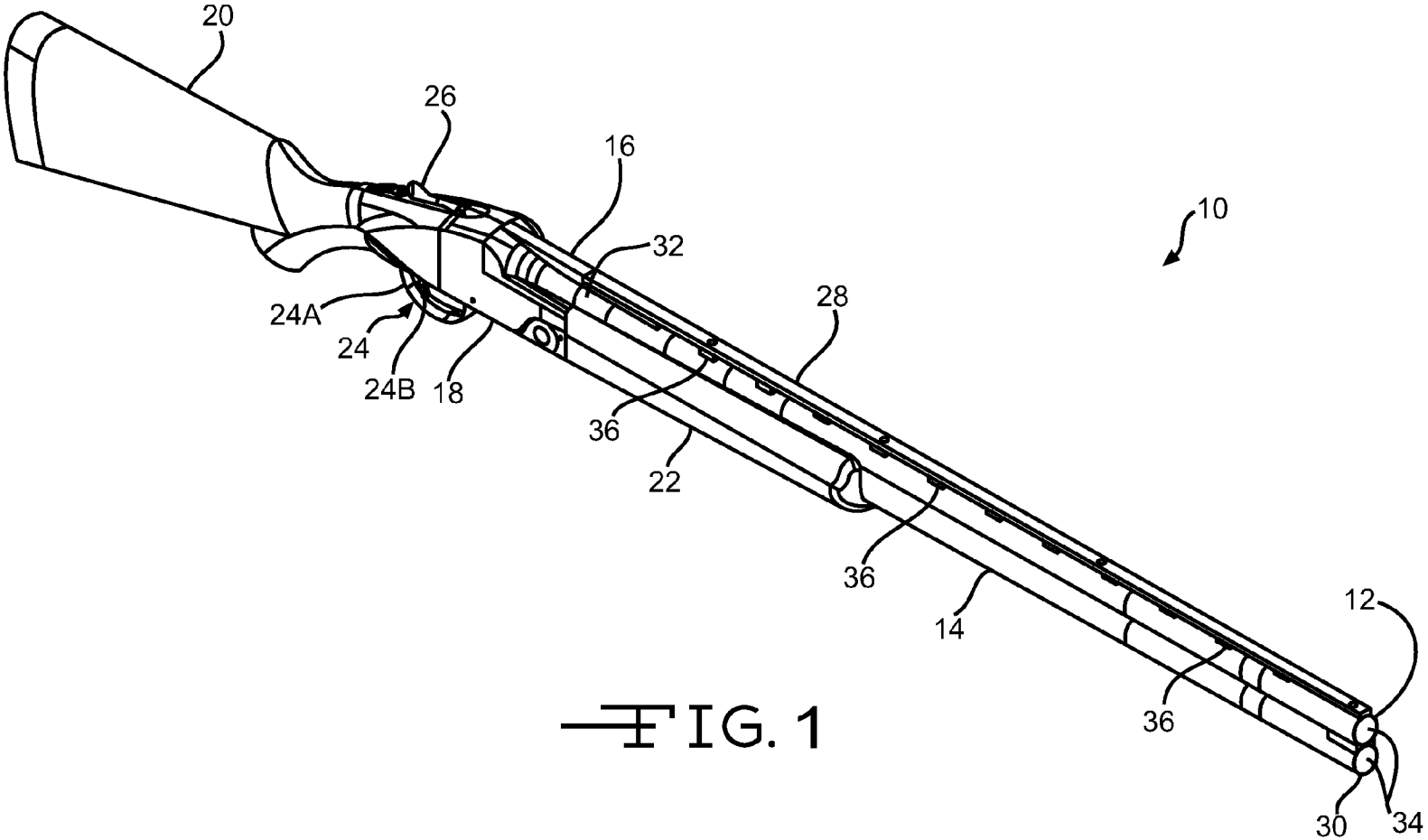
FIG. 1 is a perspective view of an embodiment of an over/under shotgun in accordance with this invention.

Referring now to FIG. 1, there is illustrated an embodiment of an over/under shotgun, indicated generally at 10, adapted with various improvements in accordance with this invention. The term "over/under" as used herein, is defined to mean a configuration of a shotgun having two barrels arranged in a common vertical plane. While the various improvements to the shotgun 10 are illustrated in the particular embodiment of an over/under shotgun, it is within the contemplation of this invention that the various improvements disclosed and illustrated herein can be applied to other types, styles, sizes and/or configurations of shotguns, such as for example side-by-side barrel configurations. Accordingly, the term "shotgun" as used herein in connection with this invention is defined to mean any type, style, size and/or configuration of shotgun.

Generally, in the illustrated embodiment of this invention, the over/under shotgun 10 includes an upper barrel 12, a lower barrel 14, a mono-block 16, a receiver 18, a rear stock 20, a fore stock 22, a trigger 24, a bolt lever 26 and a rib 28. Alternatively, the particular construction and/or configuration of the shotgun 10 can be other than illustrated if so desired.

Generally, in the illustrated embodiment, the upper barrel 12 and the lower barrels 14 are tubes or cylinders through which a controlled explosion or rapid expansion of gases is released in order to propel a projectile (not shown) out of an associated muzzle end 30 of the each of the barrels 12 and 14 at a relatively great speed. The upper barrel 12 and the lower barrel 14 can be made of any suitable material, such as for example steel alloys, and can have an outer surface finished with any desirable finish, such as for example bluing or plating. Alternatively, the particular construction and/or configuration of one or both of the upper barrel 12 and/or the lower barrel 14 can be other than illustrated if so desired.

Referring again to FIG. 1, each of the upper barrel 12 and the lower barrel 14 includes the muzzle end 30 and a breech end 32. The muzzle end 30 of the upper barrel 12 and the lower barrel 14 is the end from which the projectile exits each of the barrels 12 and 14. In the illustrated embodiment, the breech end 32 of the upper barrel 12 and the lower barrel 14 is connected to the mono-block 16. A bore 34 extends within each of the upper barrel 12 and the lower barrel 14 from the breech end 32 to the muzzle end 30 thereof. In a non-illustrated embodiment of the invention wherein the associated firearm is a rifle or handgun, the bore 34 defines the diameter of the projectile (ammunition) used within at least one of the barrels 12 and 14, and is referred to as the "caliber". In other embodiments of the invention wherein the firearm is a shotgun, the bore 34 defines the number of solid spheres of a diameter equal to the inside diameter of at least one of the barrels 12 and 14 that could be made from a pound of lead and is referred to as the "gauge".

In the illustrated embodiment, the rib 28 is attached to the upper barrel 12 of the shotgun 10 and is configured to provide or define a sighting plane to assist a shooter in the aiming of the shotgun 10 In the illustrated embodiment, the rib 28 is positioned on an upper portion of the upper barrel 12 and extends from the breech end 32 of the upper barrel 12 to the muzzle end 30 of the upper barrel 12. Alternatively, the construction and/or configuration of the rib 28 can be other than illustrated if so desired. For example, the rib 28 can extend along only a selected portion of a distance from the breech end 32 of the upper barrel 12 to the muzzle end 30 of the upper barrel 12.

In the illustrated embodiment, the rib 28 is a relatively thin, flat bar or piece of a suitable material. Alternatively, in other embodiments, the rib 28 can have any desired shape and/or size. In the illustrated embodiment, the rib 28 is made of steel; however, the rib 28 can be made of other suitable materials, such as for example aluminum or brass. In yet other alternative embodiments, the rib 28 can include cutouts, which are preferably formed by machining, to provide a ventilated rib configuration (not shown).

In the illustrated embodiment, the rib 28 is preferably removably or non-permanently attached to a series of fixtures or members 36 which are preferably machined directly into the parent material of the upper barrel 12. Alternatively, the rib 28 can also be permanently attached to the fixtures 36 by any desired manner, such as for example welding or brazing, if so desired. In still other embodiments, the rib 28 can be directly and permanently attached to the upper barrel 12 without the use of fixtures 36 if so desired.

In the illustrated embodiment, the breech end 32 of the upper barrel 12 and the lower barrel 14 are each fitted into the mono-block 16 of the shotgun 10. The mono-block 16 is preferably typically machined from a single solid piece of steel and forms the breech end of the upper barrel 12 and the lower barrels 14 and will be discussed in more detail below. Alternatively, the mono-block 16 can be made of other desired materials.

In the illustrated embodiment, the mono-block 16 is fitted or received into the receiver 18. The receiver 18 is a housing for the mono-block 16 and a firing mechanism (not shown). The receiver 18 can be made of any desired materials, such as for example, steel, titanium and aluminum. Alternatively, the receiver 18 can be made of other suitable materials if so desired.

In the illustrated embodiment, the rear stock 20 is connected to the receiver 18 and is configured to provide a support for the shooter of the shotgun 10. Typically to accomplish this, the remote end of the rear stock 20 is positioned against a shoulder of the shooter. In the illustrated embodiment, the rear stock 20 is made of wood. In other embodiments, the rear stock 20 can be other desired materials or structures sufficient to provide a support for the shooter.

The fore stock 22 is positioned forward of the rear stock 20 and is configured to provide a grip for the non-trigger hand of the shooter of the shotgun 10. In the illustrated embodiment, the fore stock 22 is made of wood. Alternatively in other embodiments, the fore stock 22 can be made from other desired materials and/or structures sufficient to provide a grip for the non-trigger hand of the shooter of the shotgun 12.

In the illustrated embodiment, a trigger, indicated generally at 24, is preferably positioned below the receiver 18 of the shotgun 12. The trigger 24 is a mechanism that actuates the firing sequence of the shotgun 10. Typically, the trigger 24 consists of a guard 24A and a lever 24B which is adapted to be actuated by an index finger of the shooter of the shotgun 12. However, other firing mechanisms and/or methods of actuating the trigger 24 of the shotgun 12 can be used if so desired.

In the illustrated embodiment, the bolt lever 26 of the shotgun 10, which will be discussed below in detail, is connected to the receiver 18 and when actuated, is configured to allow the shotgun 10 to hingeably "break" into two parts. The break-action of an over/under shotgun 10 exposes the bore 34 of the breech end 32 of the upper barrel 12 and the lower barrel 14 for the loading and the unloading of the associated ammunition of the shotgun 10.

Figure 2:
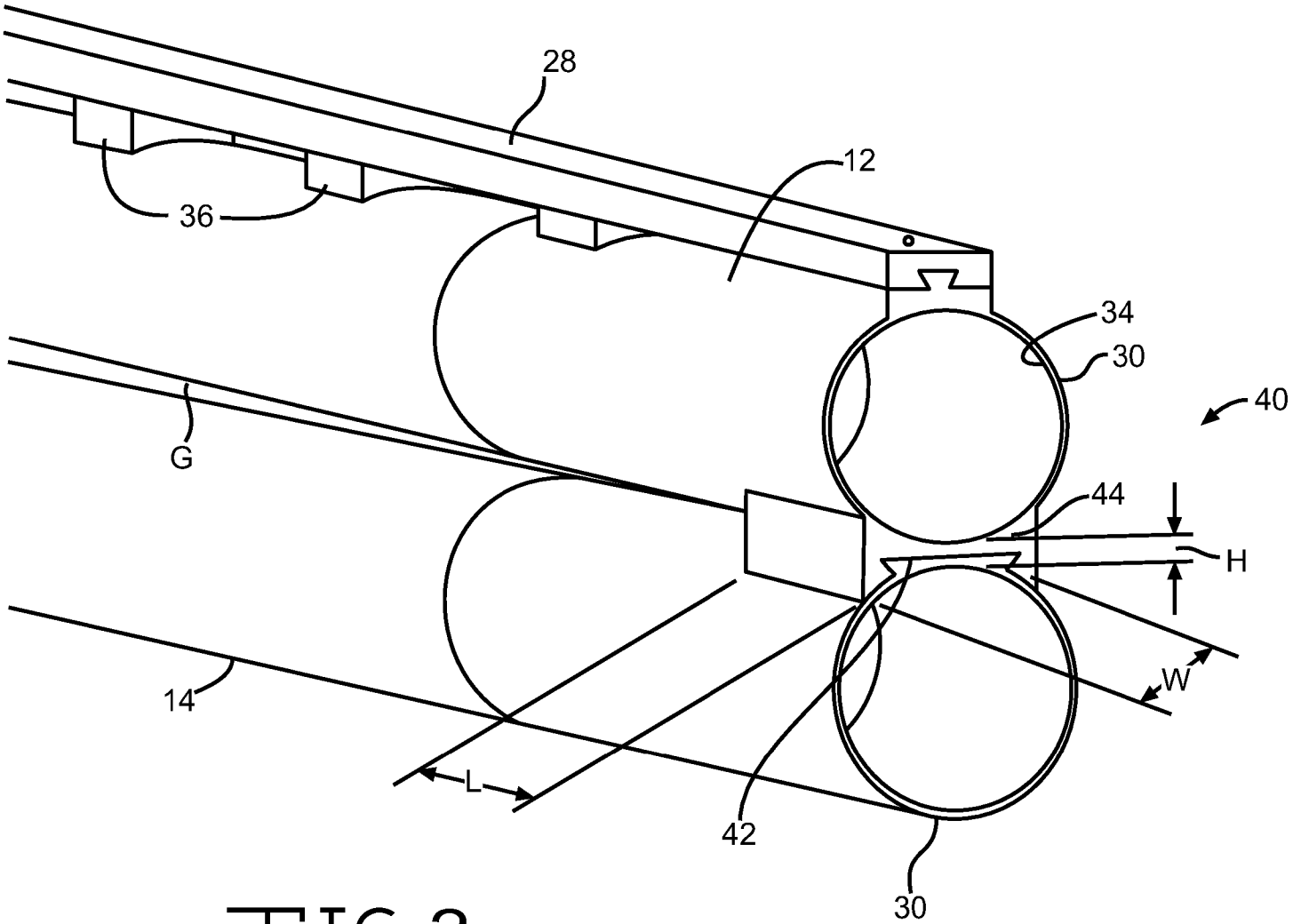
FIG. 2 is an enlarged perspective view of the muzzle end portion of the over/under shotgun of FIG. 1 illustrating an expansion joint thereof.

Referring now to FIG. 2, in the illustrated embodiment of the shotgun 10, the muzzle end 30 of each of the upper barrel 12 and the lower barrel 14 are mated together in an expansion joint, indicated generally at 40. In the illustrated embodiment, the expansion joint 40 replaces the traditional heat-related methods of permanently joining multiple barrels of a shotgun together, such as for example soldering, brazing or welding. Generally, in the illustrated embodiment, the expansion joint 40 is configured to allow one of the mated upper and lower barrels 12 and 14 to expand in a linear direction relative to the other one of the upper and lower barrels 12 and 14. The one of the mated upper and lower barrels 12 and 14 may expand in a linear direction as a result of thermal expansion. Thermal expansion can result from the substantial or extensive use of one of the barrel 12 and 14 rather than the substantially equal use of both barrels 12 and 14.

Without being held to the theory, it is believed that the temperature of a repeatedly used one of the barrels 12 and 14 can exceed 200° F., thereby causing a relative temperature difference of at least 100° F. with the lesser used one of the barrels 12 and 14. As a result of the increased temperature of the repeatedly used one of the barrels 12 and 14, such barrel can expand in a linear direction by as much as around 0.030 inches to around 0.040 inches. By allowing one of the mated barrels 12 and 14 to move relative to the other one of the mated barrels 12 and 14, the traditional problems associated with linear growth of the heated barrel, that is, ultimately causing the barrels to bow and the associated loss of shooting accuracy, is substantially eliminated.

Referring again to FIG. 2, the muzzle end 30 of each of the upper barrel 12 and the lower barrel 14 are mated together in the expansion joint 40. Generally, in the illustrated embodiment the expansion joint 40 is preferably configured as a "keying" feature, such as a mating dovetail structure, which allows for linear motion along a "major" axis of the upper and lower barrels 12 and 14. The illustrated expansion joint 40 includes a male dovetail portion 42 and a female dovetail portion 44. In the illustrated embodiment, the male dovetail portion 42 is preferably machined into the parent material of the lower barrel 14 and the female dovetail portion 42 is similarly machined into the parent material of the upper barrel 12. Alternatively, in other embodiments the male dovetail portion 42 can be formed in the upper barrel 12 and the female dovetail portion 44 can be formed in lower barrel 14. Also, the keying feature of the expansion joint 40, e.g., the dovetail portions 42 and 44, can be formed separate from one or both of the barrels 12 and 14 and joined thereto by suitable processes, such as for example welding or soldering, if desired.

As shown in FIG. 2, in the illustrated embodiment the expansion joint 40 defines a length L, a width W and a height H. In the illustrated embodiment, the length L is approximately 1.0 inches, the width W is approximately 0.66 inches, and the height H is approximately 0.13 inches. Alternatively, the dimensions of one or more of the length L, the width W and/or the height H of the expansion joint 40 can be other than illustrated if so desired.

As discussed above, the expansion joint 40 preferably allows for the linear motion of one of the barrels 12 and 14 relative to the other barrel along the major axis of the barrels 12 and 14. While allowing for the relative linear motion of one of the barrels 12 and 14, the expansion joint 40 is also provided to securely hold the mated barrels 12 and 14 together. Accordingly, the male and female dovetail portions 42 and 44 of the barrels 14 and 12, respectively, preferably have a relatively high or tight tolerance. In the illustrated embodiment, the tolerance between the male and female dovetail portions 42 and 44 is preferably approximately 0.001 inch. However, the tolerance between the male and female dovetail portions 42 and 44 can be other desired dimensions which are sufficient to securely hold the mated barrels 12 and 14 together if so desired. Also as shown in embodiment illustrated in FIG. 2, there exists a slight gap G between the associated adjacent outer surfaces of the barrels 12 and 14 adjacent the muzzle ends 30 thereof. Alternatively, there could be substantially no gap G between the adjacent outer surfaces of the barrels adjacent the muzzle ends 30 thereof if so desired.

While the embodiment illustrated in FIG. 2 shows an expansion joint 40 having a keying or mating portions 42 and 44 with dovetail cross-sectional shapes, it should be appreciated the mating portions 42 and 44 could have other suitable cross-sectional shapes if so desired, such as for example, multiple dovetails, an hour glass shape or any other suitable shape which is sufficient to form the expansion joint 40. Alternatively, the construction and/or configuration of the expansion joint 40 can be other than illustrated and described if so desired.

Figure 3:
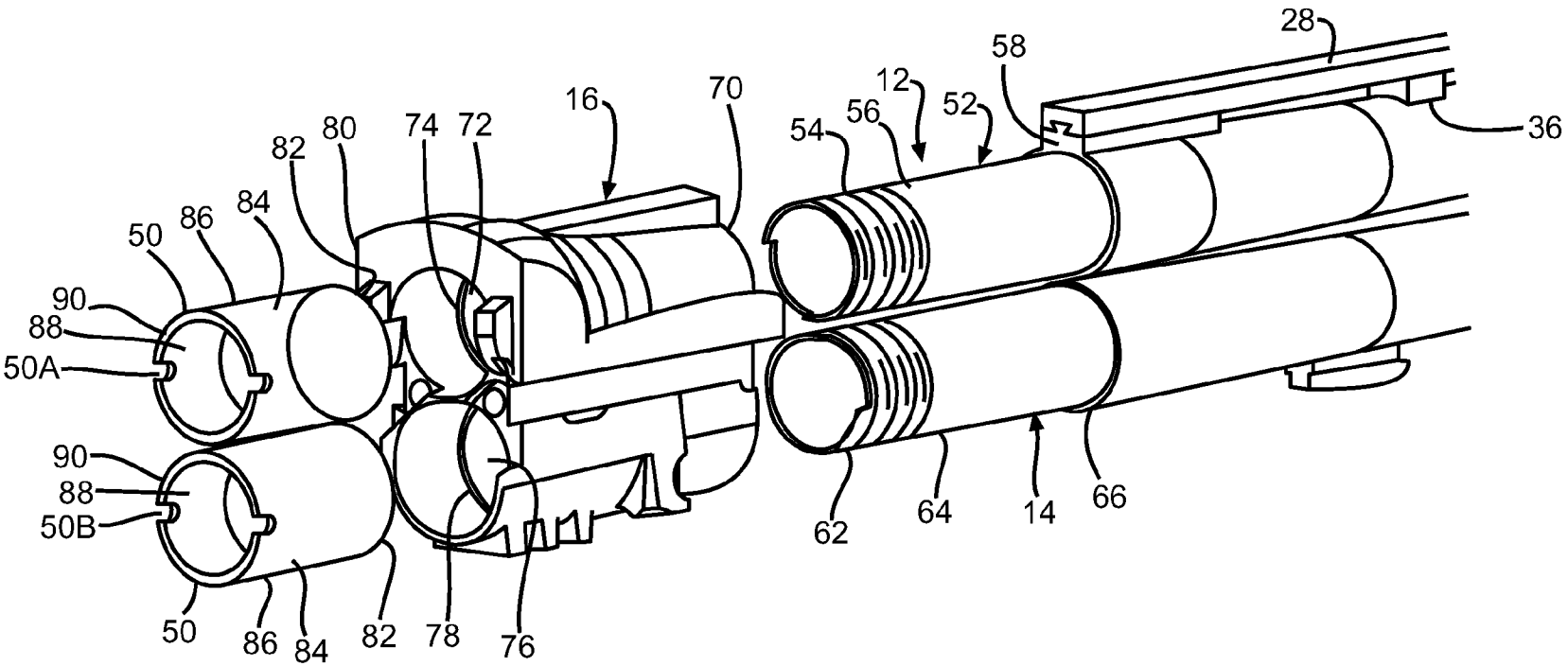
FIG. 3 is perspective view of the assembly of upper and lower barrels to the mono-block portion of the over/under shotgun of FIG. 1.
Figure 4:
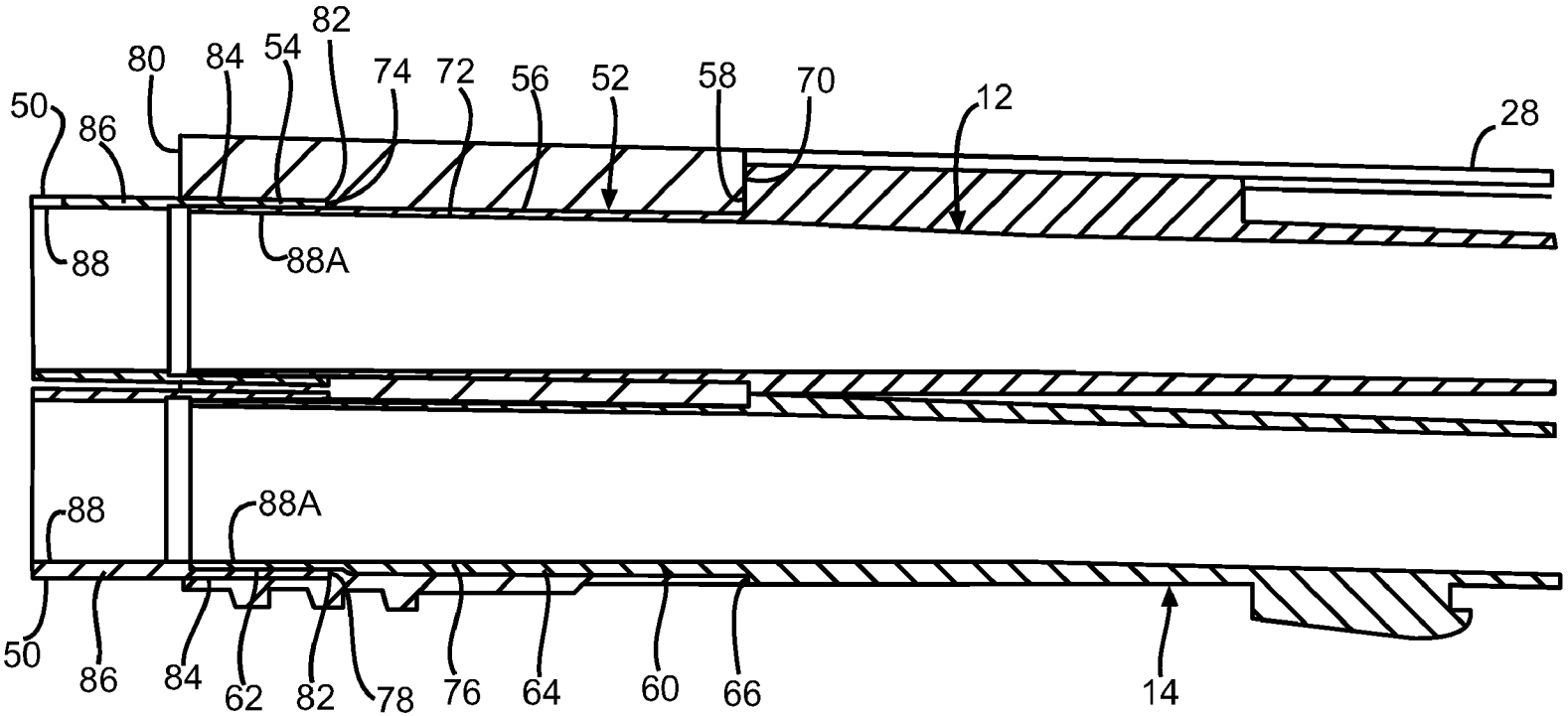
FIG. 4 is a side view in elevation of the assembly of FIG. 3.

Referring now to FIGS. 3 and 4, there is illustrated another embodiment of the shotgun 10 wherein the upper barrel 12 and the lower barrel 14 are permanently secured in the mono-block 16 by a plurality of tube nuts 50. The attachment of the upper barrel 12 and the lower barrel 14 to the mono-block 16 by the tube nuts 50 replaces the traditional heat-related joining methods, such as for example, soldering, brazing or welding.

As shown in FIG. 3, the upper barrel 12 has an upper barrel breech end 52. In the illustrated embodiment, the upper barrel breech end 52 is provided with a first or inner upper barrel external threaded portion 54, a second or intermediate non-threaded upper barrel extension portion 56, and a third or outer upper barrel shoulder 58. Similarly, the lower barrel 14 has a lower barrel breech end 60. The lower barrel breach end 60 is provided with a first or inner lower barrel external threaded portion 62, a second or intermediate non-threaded barrel extension portion 64, and a third or outer lower barrel shoulder 66.

Referring again to FIGS. 3 and 4, the mono-block 16 has a leading or outer end surface 70, a first or upper bore 72, a first or upper shoulder 74, a second or lower bore 76, a second or lower shoulder 78 and a trailing or inner end surface 80.

As shown in FIGS. 3 and 4, the tube nuts 50 have a first or outer end surface 82, an outer surface 84, a rear portion 86, a bore 88, and a second or inner end surface 90. The tube nuts 50 also have an internal threaded portion (shown in FIG. 4 at 88A), which extends along a desired distance from the first end surface 82 toward the second end surface 90. Preferably, the internal threaded portions 88A of the tube nuts 50 extend a distance which is at least equal to the distance of the external threaded portions 54 and 62 of the respective upper and lower barrels 12 and 14. Alternatively, the construction of the internal threaded portions 88A of the tube nuts 50 can be other than illustrated and described if so desired.

Generally, in the illustrated embodiment, the upper barrel 12 and the lower barrel 14 are secured to the mono-block 16 preferably in the following manner. First, the breach ends 52 and 60 of the respective upper and lower barrels 12 and 14 are inserted past the leading surface 70 of the mono-block 16 and into the upper and lower bores 72 and 76, respectively, of the mono-block 16. The upper and lower barrels 12 and 14 are inserted until the upper and lower barrel shoulders 58 and 66, respectively, seat or engage against the leading surface 70 of the mono-block 16. In this position, the external threaded portions 54 and 62 of the upper and lower barrels 12 and 14, respectively, and the barrel extension portions 56 and 64 of the upper and lower barrels 12 and 14, respectively, are disposed within the upper and lower bores 72 and 76, respectively, of the mono-block 16.

Next, the leading surface 82 of the tube nuts 50 is inserted past the trailing surface 80 of the mono-block 16 and into the upper and lower bores 72 and 76, respectively. The leading surface 82 of the tube nuts 50 is inserted until the internal threaded portions 88A of the tube nuts 50 engage the external threaded portions 54 and 62 of the upper and lower barrels 12 and 14, respectively. Next, the internal threaded portions 88A of the tube nuts 50 are threadably received onto the external threaded portions 54 and 62 of the upper and lower barrels 12 and 14, respectively, until the leading surface 82 of the tube nuts 50 seat or engage against the upper and lower shoulders 74 and 78 of the mono-block 16. Also, the second end surfaces 90 of the tube nuts 50 may have structures, such as for example, notches, bosses or slots (such slots being shown by reference character 50A and 50B in FIG. 3), which are configured to enable a suitable tool (not shown) to be used to assist in installing or torquing the tube nuts 50 onto the external threaded portions 54 and 62 of the upper and lower barrels 12 and 14, respectively, if so desired. The installation of the tube nuts 50 onto the barrels 12 and 14 can be accomplished either one at a time or can be accomplished at the same time if so desired.

In the illustrated embodiment, the tube nuts 50 are threaded onto the external threaded portions 54 and 62 of the upper and lower barrels 12 and 14, respectively, with sufficient torque so as to preferably substantially permanently secure the upper and lower barrels 12 and 14 to the mono-block 16. Once the upper and lower barrels 12 and 14 are secured to the mono-block 16 by the tube nuts 50, the rear portions 86 of the tube nuts 50 extend from the trailing surface 80 of the mono-block 16. The final step is to remove the rear portions 86 of the tube nuts 50 such that the remaining portion of the tube nuts 50 is substantially flush with the trailing surface 80 of the mono-block 16. The rear portions 86 of the tube nuts 50 can be removed in any desired manner, such as for example, a milling operation. Also, while the above-described preferred assembly method does not include the use of a thread locking substance, optionally a thread locking substance or compound, such as for example lock-tite, can be used if so desired to assist in permanently securing the upper and lower barrels 12 and 14 to the mono-block 16.

The mating threads of the external threaded portions 54 and 62 of the upper and lower barrels 12 and 14, respectively, and internal threaded portions 88A of the tube nuts 50 is required to develop sufficient strength to "permanently" secure the upper and lower barrels 12 and 14 to the mono-block 16. In the illustrated embodiment, the associated threads of the external threaded portions 54 and 62 and the associated threads of the internal threaded portions 88A of the tube nuts 50 have a 32 pitch thread, of a standard coarse, fine or extra-fine series. In other embodiments, the associated threads of the external threaded portions 54 and 62 and the associated threads of the of internal threaded portions 88A of the tube nuts 50 can have a pitch of more or less than 32 and/or can be of a different series if so desired.

In the illustrated embodiment, a minimal clearance is used between the outside diameters of the barrel extension portions 56 and 64 and the inside diameters of the bores 72 and 76, respectively, of the mono-block 16. In the illustrated embodiment, the clearance is preferably in a range of from about 0.0005 inches to about 0.001 inches. Alternatively, the clearance between the outside diameters of the barrel extension portions 56 and 64 and the inside diameters of the mono-block bores 72 and 76 can be more than about 0.001 inches or less than about 0.0005 inches if so desired.

While the embodiment shown in FIGS. 3 and 4 does not show a device or structure configured to prevent the rotation of the upper or lower barrels 12 and 14 as the tube nuts 50 are threaded onto the external threaded portions 54 and 62, respectively, thereof, it is within the contemplation of this invention that a device, structure or combination of devices and structures, such as for example a key or pin, internal to the shotgun 10 can be used to prevent the rotation of the upper or lower barrels 12 and 14 as the tube nuts 50 are threaded onto the external threaded portions 54 and 62, respectively, thereof. It is further within the contemplation of this invention that a device, structure or combination of devices and structures, such as a clamping mechanism, external to the shotgun 10 can be used to prevent the rotation of the upper or lower barrels 12 and 14 as the tube nuts 50 are threaded onto the external threaded portions 54 and 62. Also, it is within the contemplation of this invention, that a combination of the internal and external devices and structures can be used to prevent the rotation of the upper or lower barrels 12 and 14 as the tube nuts 50 are threaded onto the external threaded portions 54 and 62, respectively, thereof. It is further within the contemplation of this invention that the key feature at the muzzle end 30 and a key feature at or near the breech end 32 can be provided to substantially prevent barrel rotation.

Figure 6:
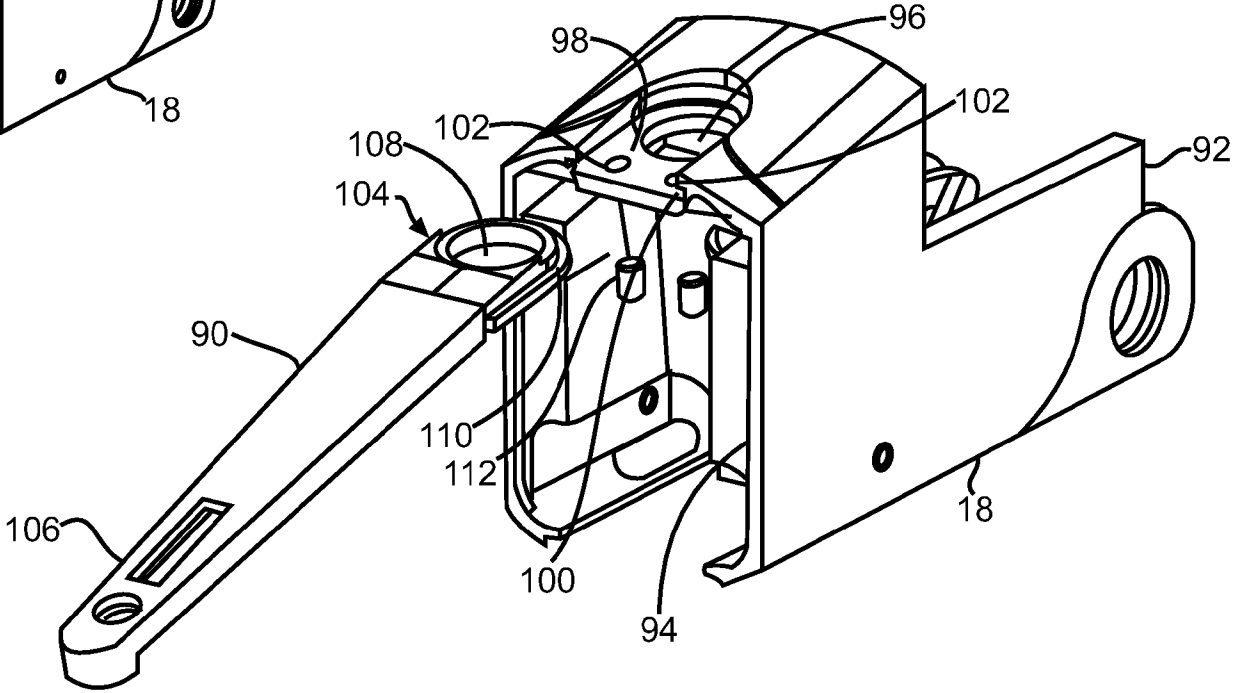
FIG. 6 is an enlarged exploded perspective view of the receiver portion and the tang portion of FIG. 5.
Figure 5:
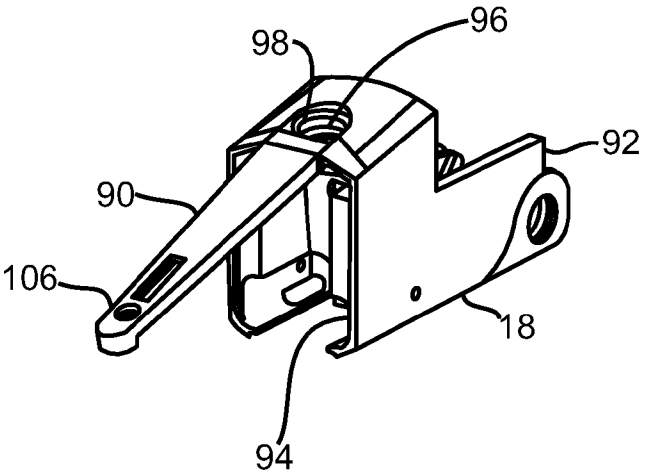
FIG. 5 is a perspective view of the receiver portion of the over/under shotgun of FIG. 1 assembled to a tang portion thereof.

Referring now to FIGS. 5 and 6, in another embodiment of this invention, the shotgun 10 includes a tang 90 which is removably attached to the receiver 18. In the illustrated embodiment, the tang 90 is preferably configured for mounting a safety selector (not shown) and a barrel selector knob (not shown). Alternatively, the tang 90 can be used for other desired functions if so desired.

The removable attachment of the tang 90 to the receiver 18 replaces the traditional methods of permanently attaching the tang 90 to the receiver 18. The traditional methods of permanently attaching the tang 90 to the receiver 18 result in a cumbersome projection extending from a rear portion 94 of the receiver 18 for downstream receiver 18 machining operations. One traditional method of handling the cumbersome projection of the tang 90 has been to simply temporarily bend the tang 90 out of position during the downstream machining operations. The embodiment of the invention shown in FIGS. 5 and 6 provides the advantage that the tang 90 can be inserted and joined to the receiver 18 at a convenient time in machining operations.

As shown in FIGS. 5 and 6, in the illustrated embodiment the receiver 18 has a receiver first or front portion 92 and the receiver second or rear portion 94. The receiver rear portion 94 has a bolt lever bore 96 and a tang mounting portion 98. In the illustrated embodiment, the tang mounting portion 98 includes a receiver slot 100 having a generally T-shaped tongue cross-sectional shape and a plurality of "pinning" bores 102.

In the illustrated embodiment, the tang 90 has a tang first or front portion 104 and a tang second or rear portion 106. Generally, the tang front portion 104 is configured for insertion into the receiver slot 100 of the receiver 18. The tang front portion 104 has a tang bolt lever bore 108 and a tang front insertion portion 110. The tang front insertion portion 110 has a generally T-shaped groove cross-sectional shape that substantially matches the T-shaped tongue cross-sectional shape of the receiver slot 100. The tang 90 also has a plurality of tang notches (not shown) positioned on the underside of the tang 90 and behind the tang lever bore 108 for a purpose to be discussed below.

To assemble the components of the receiver 18, the tang front insertion portion 110 is inserted into the receiver slot 100 until the tang bolt lever bore 108 aligns with the bolt lever bore 96 of the receiver 18 and the pinning bores 102 align with the tang notches. In the illustrated embodiment, the tang 90 is then pinned in position by using a plurality of pins 112 (two pins 112 illustrated in this embodiment), which are inserted through the pinning bores 102 and which seat against the tang notches. As can be readily understood, by using this method of removably attaching the tang 90 to the receiver 18, the tang 90 can be "unpinned" and readily removed from the receiver 18 until such time the desired downstream receiver 18 machining operations are completed and then the tang 90 can be pinned and secured to the receiver 18 by the above-described method. Alternatively, the tang 90 can be removably secured to the receiver 18 by other suitable methods and/or devices if so desired.

While the illustrated embodiment shown in FIGS. 5 and 6 discloses a quantity of two pins 112 and two pinning bores 102, it should be understood that any desired number of pins 112 and corresponding number of pinning bores 102 can be used. Also, in the embodiment illustrated in FIGS. 5 and 6, the pins 112 are cylindrical members. Alternatively, the pins 112 can be any device or structure, such as for example, screws or clips sufficient to removably pin the tang 90 to the receiver 18. In addition, while the embodiment illustrated in FIGS. 5 and 6 illustrate a matching tang front insertion portion 100 and a tang mounting portion 98 having a generally T-shaped tongue and groove configuration, it is within the contemplation of this invention that the cross-sectional shapes of the tang front insertion portion 100 and the tang mounting portion 98 can have other suitable matching cross-sectional shapes, such as for example dovetails, if so desired.

Preferably, the associated break open lever bores 108 and 96 in the tang 90 and receiver 18, respectively, are done after the tang 90 is inserted and fastened to the receiver 18 for perfect alignment therewith. Although FIG. 6 shows the bores 108 and 96 in exploded arrangement, preferably the bores 108 and 96 are done after assembly. Preferably, the tang 90 is fastened in a substantially permanent manner by use of the pins 112 and possibly aided by other means, such as for example, localized welding or soldering.

Figure 8:
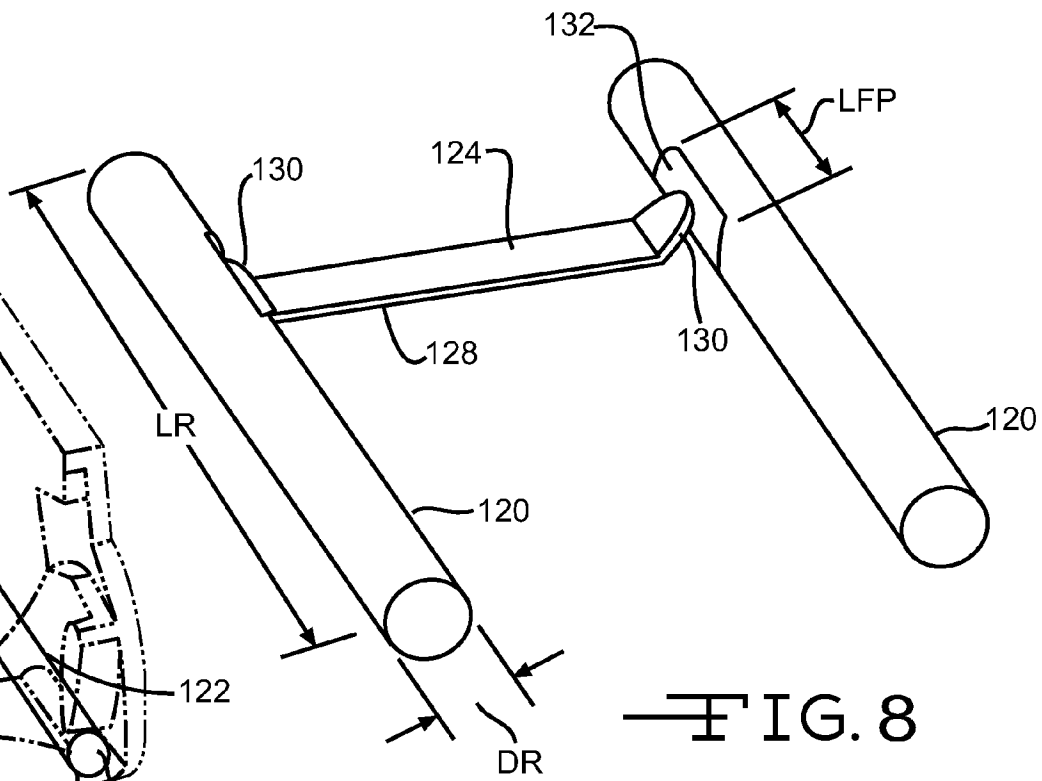
FIG. 8 is an enlarged perspective view of the plurality of cocking rods and the retaining member of FIG. 7.
Figure 7:
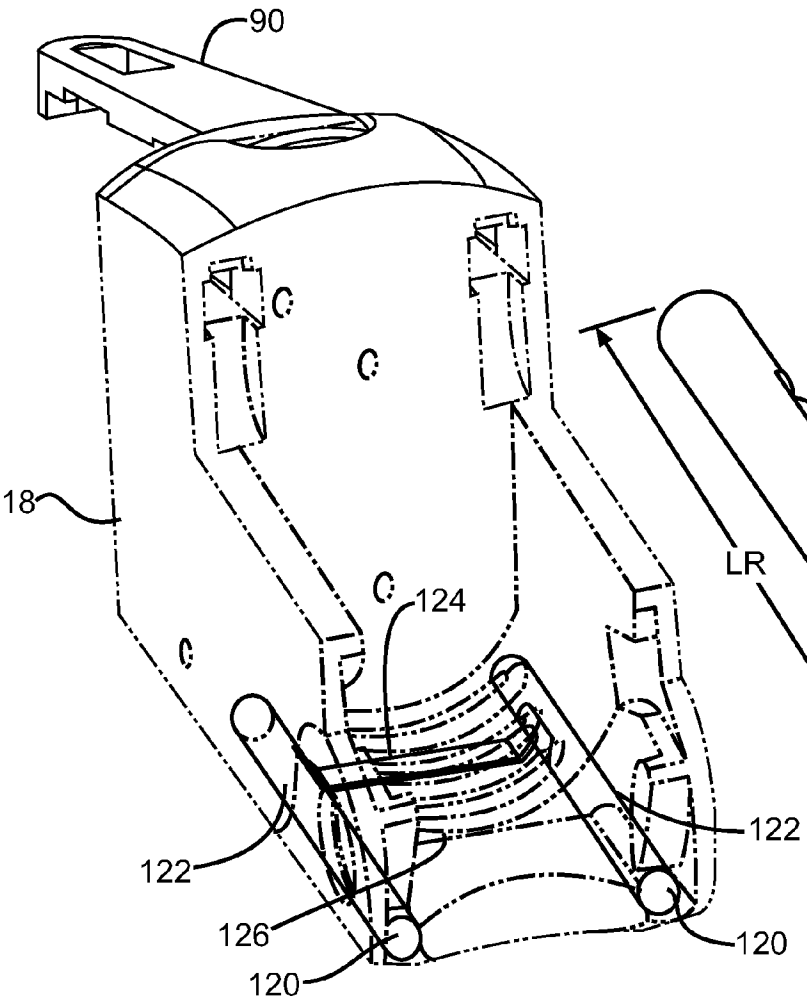
FIG. 7 is a perspective view of the receiver portion of the over/under shotgun of FIG. 1 illustrating the position of a plurality of cocking rods and a retaining member thereof.
Figure 9:
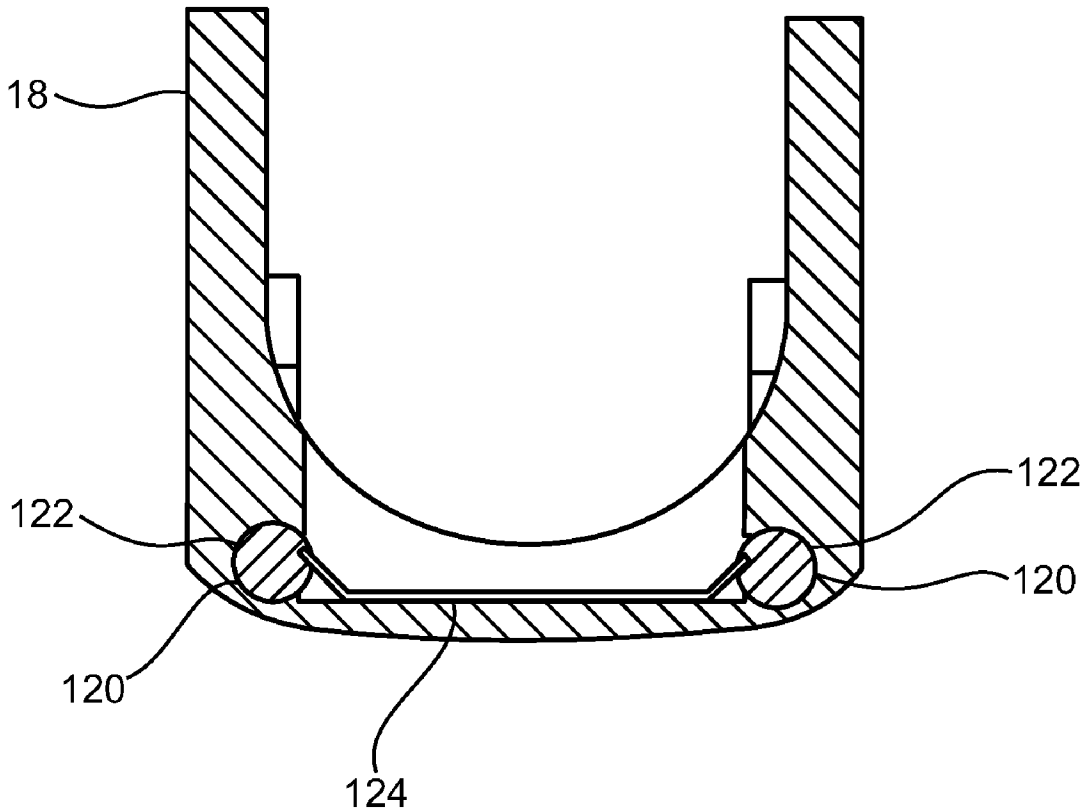
FIG. 9 is an enlarged sectional view of the receiver portion of FIG. 7 illustrating the position of the plurality of cocking rods and the retaining member thereof.

Referring now to FIGS. 7-9, in another embodiment of the shotgun 10, a plurality of cocking rods 120 slidably link between levers (not shown) that cock the hammer in the firing mechanism within the receiver 18 of the shotgun 10. In the embodiment illustrated in FIGS. 7-9, two cocking rods 120 are used, one for the upper barrel 12 and one for the lower barrel 14 of the shotgun 10. However, in another embodiment, more or less than two of such cocking rods 120 can be used if so desired.

As shown in FIGS. 7 and 9, generally the cocking rods 120 are positioned or disposed within corresponding channels 122 formed within the receiver 18 (the receiver 18 being shown in phantom so that the rods 120 can be clearly seen), and are retained within the channels 122 of the receiver 18 by a retaining member 124. As shown therein, the channels 122 are positioned in a bottom or lower portion of the receiver 18 and are oriented so as to extend parallel to one another and parallel relative to a length defined by the receiver 18.

As shown in FIG. 7, the receiver 18 has a plurality of mounting slots 126 oriented in a direction generally perpendicular to and intersecting the channels 122. The retaining member 124 is configured to fit within a selected one of the mountings slot 126 and to intersect or operatively engage the cocking rods 120.

Referring now to FIG. 8, in the illustrated embodiment each of the cocking rods 120 is in the shape of a generally cylindrical rod having a length LR and a diameter DR. In the illustrated embodiment, the length LR of the cocking rod 120 is approximately 2.4 inches and the diameter DR of the cocking rod 120 is approximately 0.1875 inches. In other embodiments the length LR of the cocking rod 120 and/or the diameter DR of the cocking rod 120 can be other dimensions if so desired. While the cocking rods 120 shown in FIGS. 7-9 illustrate a cocking rod 120 having a generally cylindrical cross-sectional shape, it should be understood that the cocking rods 120 can have other cross-sectional shapes if so desired. Also, in the illustrated embodiment, the cocking rods 120 are preferably made of steel. However, the cocking rods 120 can be made of other materials if so desired.

Referring again to FIG. 8, the retaining member 124 is shown in position relative to the cocking rods 120. Generally, the retaining member 124 is configured to retain the cocking rods 120 as the cocking rods 120 slide in the channels 122 of the receiver 18. The retaining member 124 has an main body or extension portion 128 and opposed end portions 130. In the illustrated embodiment, the end portions 130 have a generally rounded shape and extend at an angle relative to the main body 128 thereof. However, the end portions 130 can have any suitable shape if so desired.

In the illustrated embodiment, the retaining member 124 is preferably made of flat spring steel. However, the retaining member 124 can be made of other suitable materials if so desired, such as for example, of a wire shape or plastic. While the illustrated embodiment provides for a retaining member 124 made of generally flat spring steel, it should be understood that the retaining member 124 could be made of a wire shape sufficient to retain the cocking rods 120 as the cocking rods 120 slide in the channels 122 of the receiver 18.

In the illustrated embodiment, the end portions 130 of the retaining members 124 are configured to seat within a recessed flat portion 132 formed in a portion of the cocking rods 120. In the illustrated embodiment, the flat portion 132 of the cocking rods 120 has a length LFP of approximately 0.38 inches. Alternatively, the length LFP can be more or less than approximately 0.38 inches if so desired.

The illustrated embodiment of the cocking rods 120 and the retaining member 124 illustrated in FIGS. 7-9 provides advantages over traditional methods of retaining the cocking rods 120. First, the illustrated embodiment allows for "headless" cocking rods 120, thereby simplifying the machining operations of the receiver 18. Second, the illustrated embodiment allows for a retainer 124 that can be positioned within the receiver 18 without extending through the receiver 18 thereby improving the aesthetics or appearance of the receiver 18.

Figure 10:
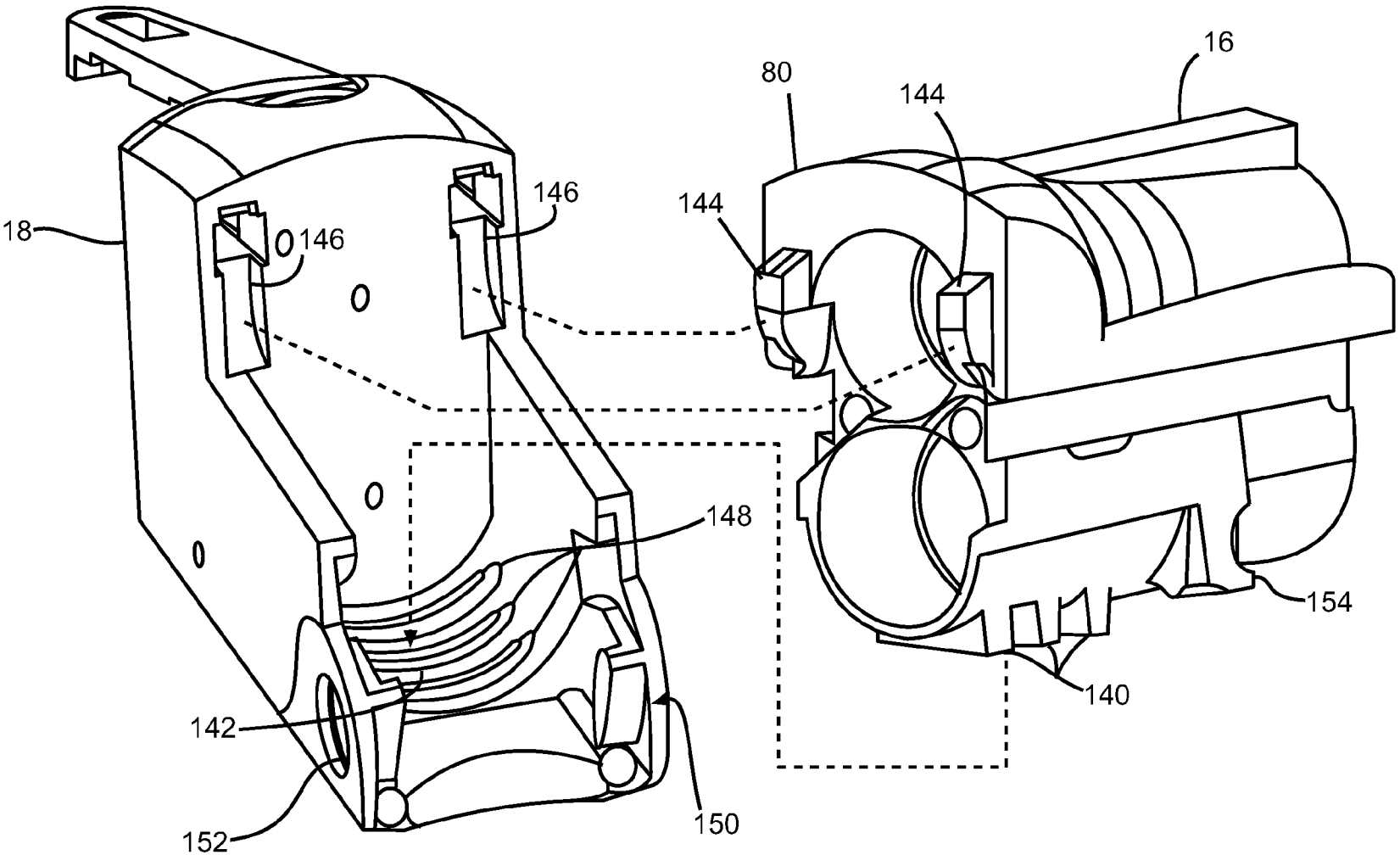
FIG. 10 is a perspective view of the receiver portion connected to the mono-block portion of the over/under shotgun of FIG. 1.

Referring now to FIG. 10, there is illustrated another embodiment of the shotgun 10 wherein the mono-block 16 has a plurality of protrusions 140 that engage a gear rack 142 positioned on the receiver 18 as the mono-block 16 pivots into assembly with the receiver 18. As discussed above, the mono-block 16 is generally pivotally connected to the receiver 18 and, as shown in this embodiment, this is accomplished by a pivot point, indicated generally at 150. In the illustrated embodiment, this is accomplished by a pair of pivot pins (not shown) that fit into the receiver 18 on both sides of a pair of openings 152 which are provided on the opposed sides of the receiver 18 (only one of the openings 152 on the receiver 18 shown in FIG. 10). The pivot pins movably mate with partial radial sockets 154 which are provided on the mono-block 16 (only one of the sockets 154 on the side of the mono-block 16 is shown in FIG. 10). For purposes of safety and efficient operation in the assembled position, the mono-block 16 should be connected to the receiver 18 in a manner to ensure a reliably solid and secure connection.

To accomplish such a solid and secure connection in the assembled position, in the illustrated embodiment shown in FIG. 10 the plurality of protrusions 140 provided on an exterior surface of the mono-block 16 engage the gear rack 142 provided on the receiver 18, and bosses 144 provided on the rear surface 80 of the mono-block 16 engage notches 146 provided on the receiver 18. In the illustrated embodiment, the bosses 144 are held in place against the notches 146 preferably by bolts (not shown) actuated by a bolt lever (not shown).

In the illustrated embodiment, the protrusions 140 have a gear-teeth like shape. In other embodiments, the protrusions 140 can have other suitable shapes if so desired. While the embodiment shown in FIG. 10 illustrates a quantity of three protrusions 140, it should be understood that more or less than a quantity of three protrusions 140 can be used if so desired.

The protrusions 140 are configured to engage the gear rack 142 as the mono-block 16 is pivoted into a closed position against the receiver 18. Accordingly, the gear rack 142 has a plurality of indentations or recesses 148 that mate with the protrusions 140. In the illustrated embodiment, the indentations 148 have a shape that mates or corresponds to the shape of the gear-teeth of the protrusions 140. In other embodiments, the indentations 148 of the gear rack 142 can have other suitable shapes which mate or correspond to the shape of the protrusions 140 if so desired.

Referring again to FIG. 10, in the illustrated embodiment, the protrusions 140 are preferably made from the stock material used to form the mono-block 16 and are formed during the same machining operations that form the other parts of the mono-block 16. However, the protrusions 140 can be made of materials different from the mono-block 16 and subsequently attached to the mono-block 16 if so desired.

Figure 11:
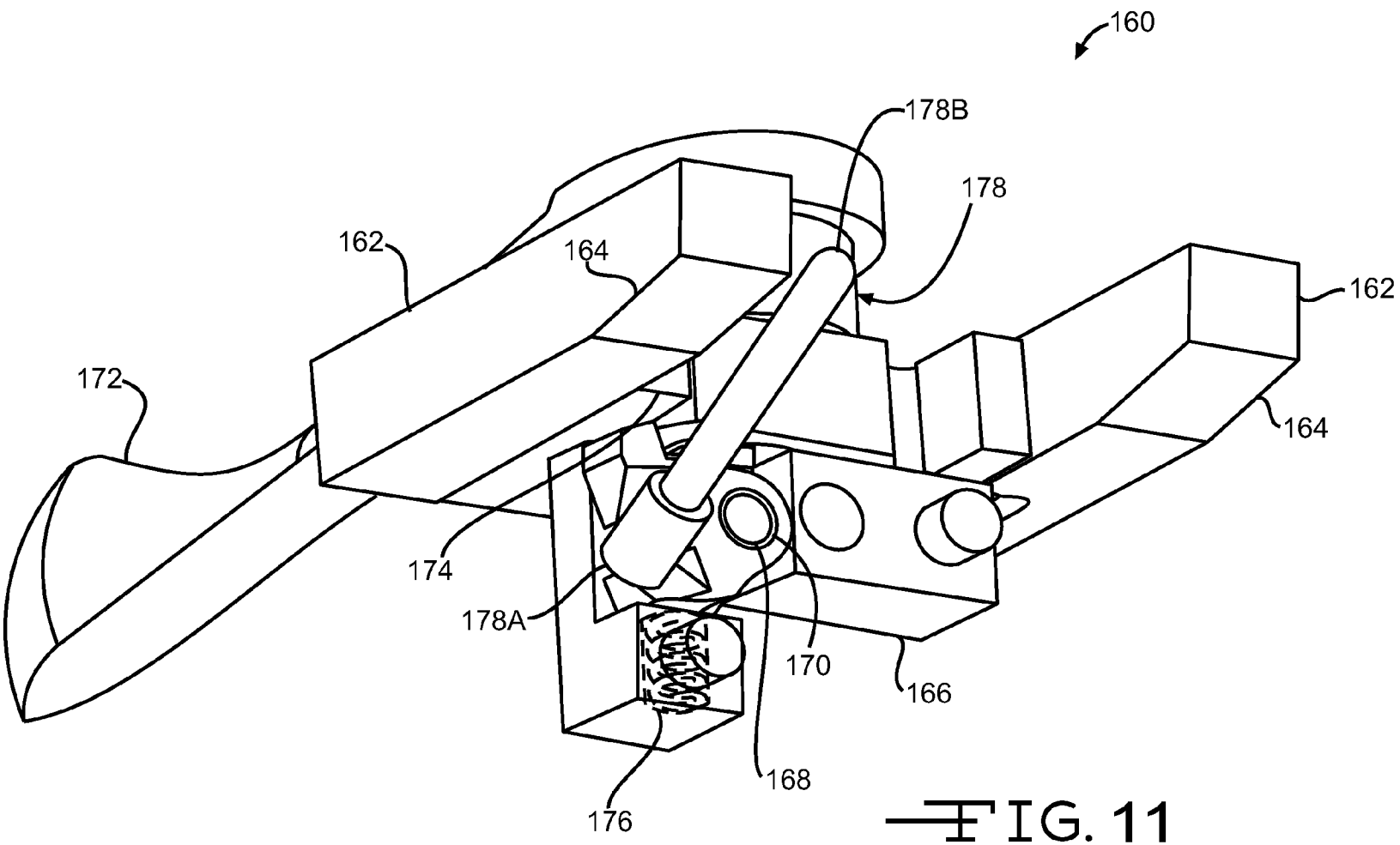
FIG. 11 is a perspective view of a locking bolt latch portion of the over/under shotgun of FIG. 1.
Figure 12:
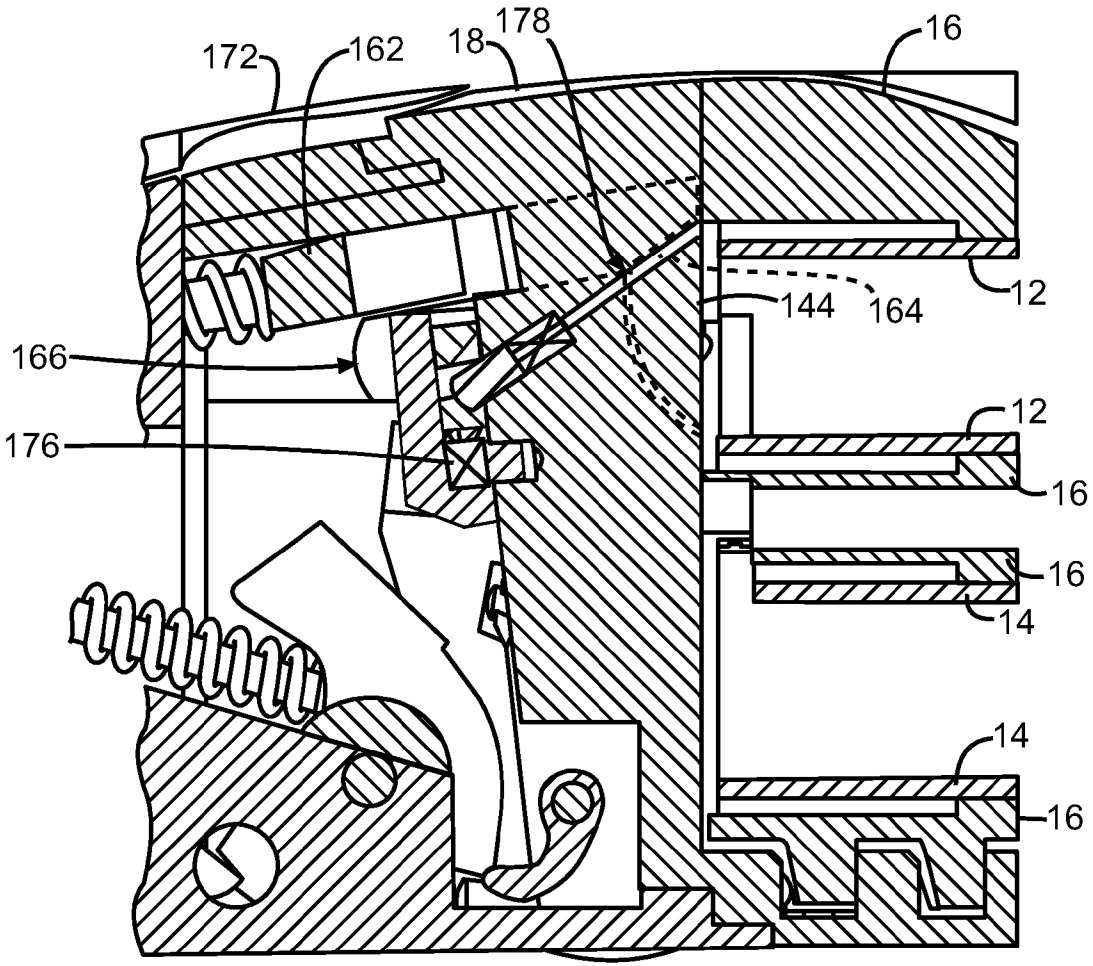
FIG. 12 is a side view in elevation of the locking bolt latch of FIG. 7.

Referring now to FIGS. 11 and 12, there is illustrated another embodiment of the shotgun 10 wherein a lever actuated bolting mechanism 160 is used to retract a plurality of locking bolts 162 when the associated shotgun 10 is opened. Generally, the lever actuated bolting mechanism 160 are operative to hold or retain the plurality of locking bolts 162 in a retracted position to permit closing of the mono-block 16 containing the upper and lower barrels 12 and 14 of the shotgun 10 without interference after loading or extracting of the shotgun shells (not shown).

The lever actuated bolting mechanism 160 includes the plurality of locking bolts 162 slidably positioned within the receiver 18. As best shown in FIG. 11, the locking bolts 162 have an angled portion 164. As shown in FIG. 12, when the mono-block 16 is in a closed positioned against the receiver 18 the angled portion 164 of the locking bolts 162 is seated against the bosses 144 of the mono-block 16. The angled portion 164 of the locking bolts 162 seating against the bosses 144 thereby prevents the mono-block 16 from being able to be pivoted from the illustrated closed position to an open position (not shown).

Referring again to FIG. 11, the lever actuated bolting mechanism 160 further includes a latch bracket 166, a pivot pin 168, a spring loaded pivot latch 170, a bolt lever 172, a latch edge 174, a latch spring 176 and an actuator pin 178. As shown in FIG. 11, the latch bracket 166 retains the pivot pin 168 and the latch spring 176 and is disposed within an inside or interior portion of the receiver 18. The pivot latch 170 is configured to pivot around the pivot pin 168 in the latch bracket 166. A first end 178A of the actuating pin 178 rides adjacent a face of the pivot latch 170 and a second end 178B extends through the receiver 18.

The lever actuated bolting mechanism 160 operates as follows: when turning the bolt lever 172 and breaking the shotgun 10 open, the latch spring 176 in the latch bracket 166 urges the latch 170 upward which catches on the latch edge 174 of the locking bolt 162 to keep the locking bolt 162 in a retracted position. When the shotgun 10 is closed, the rear surface 80 of the mono-block 16 pushes the actuator pin 178 into the receiver 18, which in turn urges the latch 170 in a downward direction. Urging the latch 170 in a downward direction allows the locking bolt 162 to slidably move in a forward direction thereby positioning the angled portions 164 of the locking bolts 162 against the bosses 144 of the mono-block 16 and latching the receiver 18 to the mono-block 16.

In accordance the provisions of the patent statutes, the principle and mode of operation of the invention have been explained and illustrated in its preferred embodiments. However, it should be understood that this invention may be practiced otherwise than as specifically explained and illustrated without departing from its spirit or scope.

What is claimed is:

1. A shotgun comprising:

a first barrel having a first barrel muzzle end and a first barrel breech end; and a second barrel having a second barrel muzzle end and a second barrel breech end;

wherein an expansion joint is provided adjacent the first barrel muzzle end and the second barrel muzzle end to connect together the first barrel muzzle end to the second barrel muzzle end, wherein the expansion joint includes keying portions machined into a parent material of the first and second barrels, and whereby the expansion joint is operative to allow movement of one of the first and second barrels relative to the other one of the first and second barrels to prevent bowing thereof;

wherein a mono-block is provided having a pair of bores, the first barrel breech end and the second barrel breech end each disposed in a respective one of the pair of bores of the mono-block; and wherein a pair of tube nuts are provided and each extends into a respective one of the pair of bores of the mono-block to secure a respective one of the breech ends of the first and second barrels independently of one another to the mono-block.

2. The shotgun of claim 1 wherein the expansion joint allows linear movement of the one of the first and second barrels relative to the other one of the first and second barrels.

3. The shotgun of claim 2 wherein the linear movement of the one of the first and second barrels relative to the other one of the first and second barrels is in the range of from 0.030 inches to 0.040 inches.

4. The shotgun of claim 1 wherein a tolerance between the female and the male dovetail portions is 0.001 inch.

5. The shotgun of claim 1 wherein the keying portions include a female dovetail portion in the parent material of one of the first and second barrels and a male dovetail portion in the parent material of the other one of the first and second barrels.

6. The shotgun of claim 1 wherein the shotgun is an over/under shotgun.

7. The shotgun of claim 6 wherein the first barrel is an upper barrel and the second barrel is a lower barrel and wherein the upper barrel includes a rib attached thereto by a series of members machined directly into the upper barrel.

8. An over/under shotgun comprising:

a first barrel having a first barrel muzzle end and a first barrel breech end; and a second barrel having a second barrel muzzle and a second barrel breech end;

wherein an expansion joint is provided directly adjacent the first barrel muzzle end and the second barrel muzzle end to connect together the first barrel muzzle end to the second barrel muzzle end, wherein the expansion joint includes keying portions machined into a parent material of the first and second barrels, and whereby the expansion joint is operative to allow movement of one of the first and second barrels relative to the other one of the first and second barrels;

wherein a mono-block is provided having a pair of bores, the first barrel breech end and the second barrel breech end each disposed in a respective one of the pair of bores of the mono-block; and wherein a pair of tube nuts are provided and each extends into a respective one of the pair of bores of the mono-block to secure a respective one of the breech ends of the first and second barrels independently of one another to the mono-block.

9. The over/under shotgun of claim 8 wherein the expansion joint allows linear movement of the one of the first and second barrels relative to the other one of the first and second barrels.

10. The shotgun of claim 9 wherein the tube nuts permanently secure a respective one of the breech ends of the first and second barrels to the mono-block.

11. The over/under shotgun of claim 8 wherein the keying portions include a female dovetail portion machined into the parent material of one of the first and second barrels and a male dovetail portion machined into the parent material of the other one of the first and second barrels.

12. The over/under shotgun of claim 8 wherein the first barrel is an upper barrel and the second barrel is a lower barrel and wherein the upper barrel includes a rib attached thereto by a series of members machined directly into the upper barrel.

13. The over/under shotgun of claim 12 wherein the rib is removably attached to the upper barrel.

14. The over/under shotgun of claim 8 wherein the tube nuts permanently secure a respective one of the breech ends of the first and second barrels to the mono-block.

* * * * *